United States Patent [19]

Wiesner

[11] Patent Number: 4,998,339

[45] Date of Patent: Mar. 12, 1991

[54] PROCESS FOR FABRICATION OF AN IRON MEMBER WITH A WINDING FOR GENERATION OF ELECTROMAGNETIC FIELDS

[75] Inventor: Ernst Wiesner, Dornbirn, Austria

[73] Assignee: Zumtobel Aktiengesellschaft, Dornbirn, Austria

[21] Appl. No.: 416,314

[22] PCT Filed: Jan. 23, 1989

[86] PCT No.: PCT/EP89/00064

§ 371 Date: Sep. 14, 1989

§ 102(e) Date: Sep. 14, 1989

[87] PCT Pub. No.: WO89/07325

PCT Pub. Date: Aug. 10, 1989

[30] Foreign Application Priority Data

Jan. 27, 1988 [AT] Austria ..... 165/88

[51] Int. Cl.[5] ..... H01F 41/04

[52] U.S. Cl. ..... 29/606; 29/602.1

[58] Field of Search ..... 29/605, 606, 602.1, 29/596, 736

[56] References Cited

FOREIGN PATENT DOCUMENTS 1789162 4/1976 Fed. Rep. of Germany .
3347195 7/1984 Fed. Rep. of Germany .
1560537 3/1969 France .
1568360 5/1969 France .
2448803 9/1980 France .

OTHER PUBLICATIONS

Patent Abstracts of Japan, vol. 10, No. 104 (E-397) 2161, Apr. 19, 1976 & JP-A-60 242609 (Matsushita Denki Sangyo K.K.) Dec. 2, 1985, whole doc.

Patent Abstracts of Japan, vol. 6, No. 47 (E-99) 925, Mar. 26, 1982, & JP-A-56 161631 (Hitachi Seusakusho K.K.) Dec. 12, 1981, whole doc.

Patent Abstracts of Japan, vol. 7, No. 190 (E-194) 1335, Aug. 19, 1983, & JP-A-58 93313 (Meiji National Kogyo K.K.) Jun. 3, 1983, whole doc.

*Primary Examiner*—Carl E. Hall

*Attorney, Agent, or Firm*—Toren, McGeady & Associates

[57] ABSTRACT

A method for the fabrication of an iron member with a winding for generation of electromagnetic fields. The iron member has essentially a square-shaped iron core (6) and at least one U-shaped iron yoke (7) receiving a segment of the winding; the iron core is inserted between the legs of said U-shaped iron yoke. The iron core (6) is introduced into the winding having to begin with undeformed wires and subsequently the U-shaped iron yoke (7) is slid on. Herein core (6) and yoke (7) are moved so far against each other, that the cross-sectional area of the groove bounded by the core (6) and the yoke (7) or of the winding space becomes smaller than the cross-sectional area of the segment of the winding which it to begin with not deformed and received by the winding space of the iron member formed by the core (6) and the yoke (7). Core (6) and yoke (7) are pressed against each other by a force so large, that the originally circular cross-sections of the wires forming the winding are permanently deformed across the length of the groove or the winding space receiving them.

4 Claims, 1 Drawing Sheet

PROCESS FOR FABRICATION OF AN IRON MEMBER WITH A WINDING FOR GENERATION OF ELECTROMAGNETIC FIELDS

BACKGROUND OF THE INVENTION

The invention is directed to a method for fabrication of an iron member with a winding for generation of electromagnetic fields.

It is known in the manufacture of electrical machinery to fabricate windings of electrically insulated wires and to place these into grooves of iron members, or however to also utilize the coils in regular operation without such an iron member. For the fabrication of such coils, wires with an essentially circular cross-section are used. For the fabrication of such coils either a device is used as a winding tool, and the thus fabricated coil is then inserted into the iron member, or the iron member is directly wound by placing the wire directly into its grooves. The filling or space factor of such windings or grooves is of the order of magnitude of approximately 65%, meaning, referred to the cross-sectional area of the groove or the winding, 65% of the cross-sections of the wires forming the windings are filled, the rest 35% is essentially air enclosed in the filler regions, which ar bounded by adjacent wires lying next to each other.

It is also known in the construction of electrical machinery (motors, generators, transformers for power supply) to utilize copper wires or copper bands rectangular in cross section. Here we are faced with large copper cross-sections and large winding widths. With wires having rectangular cross-sections there occur great losses of filling factors, and indeed especially at the beginning and end of each winding layer. In copper bands a large winding height is required for applying large winding numbers including insulation, in order to keep the space factor high. With copper wires having a cross-section of less then 1 $mm^2$ the laying of formed wires is difficult.

The builders of electromachinery attempt continuously to house as much winding copper as possible in a predetermined space, be it a groove or be it a winding space, because the greater the copper cross-section per unit area, the lower is the power loss and the smaller can be the dimensions of the device; also the heat loss can be dissipated so much easier and faster at lower cost, which again lowers the temperature difference between the copper of the winding and the jacket of the device, whereby again the arrangements for cooling the device can be simplified and the device itself can be built to be small because of these reasons, which on the other hand again result in economy of material. Thus, an electric coil of high density and good thermal conductivity is explained in the DE-OS 1789 162 where the winding is placed into a pressing mold and is then pressure-molded to such an extent over its entire surface or at least over a portion of its length, that the individual wires of the winding are deformed. This publication however leaves open how subsequently this winding or coil is to be inserted into the iron core. It is so-to-say only mentioned in passing, that such coils are destined for motors with distinct poles, whose pole shoes can be disassembled in order to insert the winding. In electrical machines with iron members having no distinct or disassemblable poles, it is probably difficult, if not entirely impossible, to utilize such pressure-molded coils.

The DE-PS 33 47 195 shows and describes on the other hand pressure-molded windings in connection with internally grooved iron members (stator and rotor of electrical machinery), wherein expensive auxiliary apparatus is required in order to achieve an adequate space factor in this case. It is indeed observed in the description, that these auxiliary arrangements can be replaced by the "fingers" of the person inserting the coil. This however appears to be a dubious method, since it cannot be determined how the pressure required for pressure molding of such metallic wires can be absorbed by the fingers over a long groove distance.

SUMMARY OF THE INVENTION

The invention proceeds now from this state of the art, wherein however in this case the corresponding electrical apparatus (iron core with coil) as such or its parts is advantageously directly used for the purpose of achieving the desired high winding density by pressure-molding the winding. In accordance with the present invention, the iron core is inserted into the winding which is formed by wires which are not yet deformed. Subsequently, the U-shaped iron yokes are slid on and connected with the core. The core and the yokes are displaced relative to each other to such an extend that the cross-sectional area of the groove or the winding space bounded by the core and the yokes becomes smaller than the cross-sectional area of the initially undeformed segment of the winding received by the groove or the winding space of the iron member formed by the core and yokes. The core and yokes are pressed against each other with a force which has a magnitude that causes the originally circular cross-section of the wires forming the winding to be permanently deformed and honeycomb-like shaped across the length of the groove or the winding space receiving them. Thanks to this proposal it is possible to increase the space factor of the winding space or of the winding density to 90% and even more. Since in the invention the turns of the coil are pressure-molded and deformed by those parts, which are directly part of the electrical appliance to be manufactured, it is assured that the heat loss arising in the winding during normal operation of the appliance is optimally conducted away on all sides. Apart from this, especially when wires insulated by baked varnish are used, it is achieved that the winding is tightly sealed against the atmosphere, so that one can do without impregnating the winding additionally against such influences.

In order to keep the forces required for the deformation of the wire cross-sections low, it is provided according to an additional process feature that the winding is heated to approximately 150° to 300° C. prior to or during the application of external pressure for deformation of the wire cross-section.

BRIEF DESCRIPTION OF THE DRAWING

The drawing and the following description illustrate the invention. It is shown on.

DESCRIPTION OF THE PREFERRED EMBODIMENT

Figure 1:
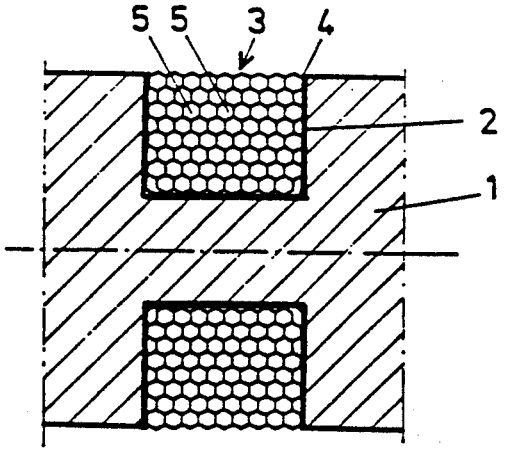
FIG. 1 a cross-section through an iron member with a groove, in which the winding described in the invention lies.

A groove 2 with an essentially rectangular cross section is configured in the iron core 1 of an electric appliance not described in detail here. This groove 2 is appropriately lined with an insulation foil 4 and in this thus-prepared groove now lie the wires 5 of a winding 3, through which direct or alternating current flows when the electrical appliance is being operated. As shown in FIG. 1, we are dealing here with a cross-section of such an iron core, the cross-section of the wires forming the winding 3 are configured as more or less regular hexagons at least in the region of the grooves 2, wherein the individual adjacent wires contact each other with their flat sides, so that these wires or their cross-section form a honeycomb-like pattern. FIG. 1 demonstrates that an extraordinarily high filling or space factor can be achieved by using such a cross-sectional shape of the wires in the winding, which as current experience shows as a rule exceeds 90%, so that the filling factor can be increased by 25 to 40% compared to the measures known hitherto. This is one-third of the original value and this amount illustrates the technical advance achievable by the invention.

The manufacture of wires with such cross-section represents no problem in itself. It is, however, more difficult to arrange wires with such uniform or regular hexagonal cross-sections in such an ordered or regular manner in a groove 2 of an iron member 1 and to insert these wires into same so that the aimed-for high filling factor is achieved in actual fact. In order to attain this, those process steps are enumerated in the following at the example of a choke coil with a closed iron core, which permit attaining this aim, in spite of the fact that a copper wire with an essentially circular cross-section, as has hitherto been the case, is used as initial material for fabrication of the winding. A so-called baked varnish wire is used. Such wires insulated by baked varnish are commercially offered by wire manufacturers for the building of electromachinery (Baked Varnish Symposium—Innovation and Technology in the Manufacture of Electric Motors—Berlin—Oct. 1979).

Figure 2:
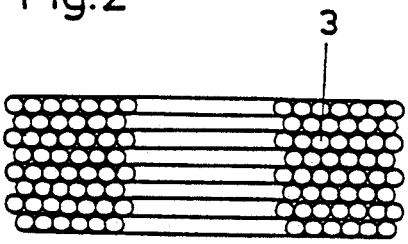
FIGS. 2–5 demonstrate diagrammatically the work processes during the fabrication method of such a winding for a choke coil with a iron core closed across its circumference.

To begin with a wire coil 3 is wound from the mentioned baked varnish wire with round wire cross-section using a suitable winding tool, which coil is depicted in cross-section in FIG. 2. The longitudinal dimension of this wire coil (perpendicularly to the plane of the drawing) is greater than its transverse dimension-(in the plane of the drawing, as depicted). The choke coil, which is cited and described here as an example, has a square-shaped iron core 6 as well as two U-shaped essentially congruent yokes, which form the outer jacket closed on its peripheral surface. Choking coils with such a core cross-section are known. To begin with an insulation foil 8 is placed into the coil wound according to FIG. 2 and then the mentioned square shaped iron core 6 is inserted (FIG. 3), the individual components assembled here are dimensioned in such a manner that this assembly of the part is possible without presenting any difficulties. The iron core can consist of lamellar metal plates or it can also be a ferrite component or a pressed or stamped component.

Figure 3:
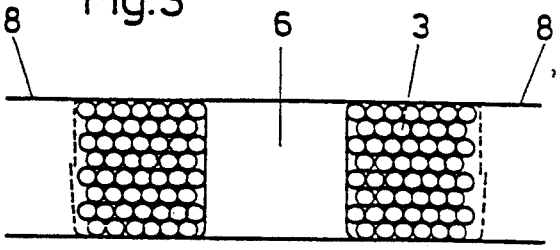
Figure 4:
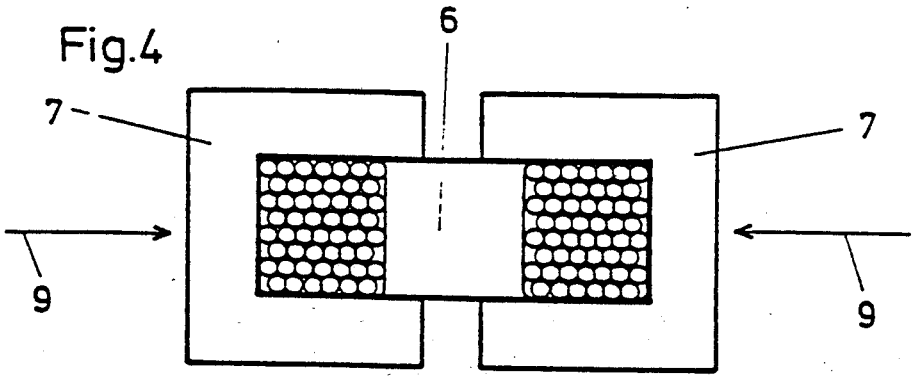
Figure 5:
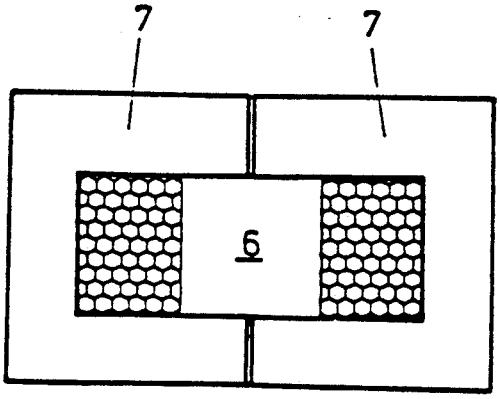

After the strips of the insulating foil 8 projecting beyond the winding of the coil 3 have been folded over (see the broken line in FIG. 3, the two U-shaped yokes 7 are subsequently placed at diametrically opposite points of the iron core 6 and subsequently are pressed against each other in direction of the arrows 9. The cross-section of the winding space of the finished choke coil (FIG. 5) is herein dimensioned to be smaller than the cross-section of the to start of with undeformed winding 3 (FIG. 2 or FIG. 3), so that by pressing the components 6 and 7 against each other (arrows 9 in FIG. 4) the winding or the wires of the winding are pressed against each other, which then deform in the previously explained way, so that the winding space of the choke attains a filling factor or space factor of 90% or even more (FIG. 5).

Considerable pressures must be applied for this deformation of the wires or the wire cross-sections. These pressures can be somewhat lowered and kept lower, if the winding 3 is heated before or during this application of pressure, for instance to 200°-300° C. This softens the baked varnish insulation, which then assumes the function of a lubricant and also the copper wire can be more easily deformed at these temperatures.

It has already been mentioned that high forces are required for deforming the cross-sections of the wire winding. It is not easily possible to give detailed concrete orders of magnitude in the this connection, since the magnitude of these forces depends on the size of the winding to be deformed and also on the level of the working temperature used in each case.

It has already been mentioned that the wires insulated by baked varnish are used for the fabrication of such windings. In view of the circumstances that such baked varnish wires have been commercially available for a long time and that already Symposia have been held dealing with the use of such wires insulated by baked varnish (Berlin—Oct. 1979), it does not appear necessary to us to explain in detail the properties of this baked varnish insulation for wires. We can refer to the papers given on the Baked Varnish Symposium in the Congress Hall of Berlin in Oct. 1979, which have been subsequently published. The invention is above all directed to windings with wires having a small cross-section, for instance of the order of 1 $mm^2$ or less.

I claim:

1. Method for fabrication of an iron member with a winding for generation of electromagnetic fields, with the iron member comprising an essentially square-shaped iron core and U-shaped iron yokes arranged in pairs receiving a segment of the winding, the iron yokes having legs, the method including inserting the iron core between the legs, preparing the winding of a plurality of turns from an electrically insulated wire of essentially circular cross-section located next to each other or over each other and subsequently applying a force to the winding or segment thereof transversely to the longitudinal extent of the wires forming the winding, the force applied being such that the wires are plastically deformed and a cross-section through such a turn segment presents itself as a honeycomb-like pattern, the improvement comprising inserting the iron core into the winding comprising undeformed wires, and subsequently sliding the U-shaped iron yokes on and connecting the yokes with the core, wherein core and yokes are displaced against each other to such an extent that the cross-sectional area of the groove or the winding space bounded by the core and the yokes becomes smaller than the cross-sectional area of the undeformed segment of the winding received by the groove or the winding space of the iron member formed by the core and yokes, and wherein core and yokes are pressed against each other with a force which causes the originally circular cross-sections of the wires forming the winding to be permanently deformed and honeycomb-like shaped across the length of the groove or the winding space receiving them.

2. Method according to claim 1, characterized in that wire with a baked varnish lining is used for manufacture of the winding.

3. Method according to claim 1, characterized in that the winding is heated prior or during the application of pressure to approximately 150°–300° C.

4. Method according to one of the claims 1 to 3, characterized in that a wire with a cross-section of approximately 1 $mm^2$ or less is utilized for fabrication of the winding.

* * * * *